United States Patent [19]

Meunier et al.

[11] 4,078,262

[45] Mar. 7, 1978

[54] CONTROLLING AN IRON-ORE AGGLOMERATION PROCESS

[75] Inventors: Henry Gilbert Meunier, Liege; Jacques Toussaint Boelens, Sclessin, both of Belgium

[73] Assignee: Centre de Recherches Metallurgiques-Centrum voor Research de Metallurgie, Brussels, Belgium

[21] Appl. No.: 717,172

[22] Filed: Aug. 24, 1976

[30] Foreign Application Priority Data

Aug. 26, 1975 Belgium ..... 832778

[51] Int. Cl.[2] ..... B28C 7/12; C22B 1/14

[52] U.S. Cl. ..... 366/151

[58] Field of Search ..... 259/154, 149, 4 R, 154, 259/149, 4 R; 73/38

[56] References Cited

U.S. PATENT DOCUMENTS

| | | | |
|---|---|---|---|
| 3,161,927 | 12/1964 | Dietert | 259/154 |
| 3,236,605 | 2/1966 | Pierson | 227/57 X |
| 3,791,793 | 2/1974 | Friedmann et al. | 23/253 A |

FOREIGN PATENT DOCUMENTS

| | | |
|---|---|---|
| 1,255,801 | 12/1971 | United Kingdom. |

*Primary Examiner*—Billy S. Taylor

*Attorney, Agent, or Firm*—Holman & Stern

[57] ABSTRACT

The permeability of a mixture to be agglomerated is measured by means of at least one permeability-measuring device situated upstream of a mixer directly preceding a feed hopper feeding an agglomerating apparatus. Water is added to the mixture in the mixer. The measured permeability value is utilized to influence the quantity of water added in the mixer by means of an automatic feed-forward regulating loop so as to obtain a given permeability at the output of the mixer. The feed-forward loop may be combined with a feedback regulating loop.

3 Claims, 6 Drawing Figures

CONTROLLING AN IRON-ORE AGGLOMERATION PROCESS

BACKGROUND OF THE INVENTION

The present invention relates to a method for the control of an iron-ore agglomeration process on the basis of a couple constituted by the values: permeability of the mixture of materials to be agglomerated, and quantity of water to be added to the mixture.

The manufacture of agglomerates includes initially making up a mixture of ores, combustible solids (for example coke), return fines, and various additions (for example fluxes). The mixture is then introduced into one or more appliances generally referred to as mixers where there is effected the addition of water with a view to achieving the requisite permeability. The mixture is then fed towards the agglomeration apparatus, e.g. a sinter strand.

The importance of the gas permeability of the mixture is well known and regulation methods have been proposed in which the permeability is measured and comparison is made between the measured value and a predetermined set value considered as ideal. If the measured value deviates from the set value, the quantity of water added to the mixture is modified so as to suppress this deviation with the least delay.

The permeability is measured by means of an appliance referred to as a "permeameter" in the present specification. The principle of this measurement is known and one of the inventors in this connection has specifically considered a novel application intended to give the measurement sufficient sensitivity (U.S. Pat. No. 3,505,856).

These modes of regulation have given very satisfactory results since they have enabled the permeability to be stabilized at values close to the set values.

In all known cases the appliance for the measurement of the permeability is always situated downstream of the mixer, which itself directly precedes the feed hopper for the agglomerating apparatus. Because of this, between the instant of the measurement of the permeability and the instant of the addition of the water there is a dead time during which the mixture is not subject to any correction and in consequence of which it can present undesirable variations of permeability.

SUMMARY OF THE INVENTION

It is an object of the present invention to remedy this disadvantage.

With this object in view the inventors have conceived the original idea of measuring the permeability of the mixture by means of at least one permeameter situated upstream of the mixer which directly procedes the feed hopper for the agglomerating apparatus. In this manner if the measured value is not satisfactory it is yet possible to regulate the addition of water effected in the mixer disposed downstream of the permeameter in order to correct the defective value.

Accordingly, the present invention provides a method of controlling an iron-ore agglomeration process, the method comprising measuring the permeability of a mixture to be agglomerated, by means of at least one permeameter situated upstream of a mixer directly preceding a feed hopper feeding an agglomerating apparatus, adding water to the mixture in the mixer, and utilizing the measured permeability value to influence the quantity of water added in the mixer by means of an automatic feed-forward regulating loop so as to obtain at the output of the mixer a given value of the permeability of the mixture to be agglomerated.

In accordance with one mode of carrying the invention into effect, the value of the permeability measured upstream of the mixer which directly precedes the feed hooper is utilized to influence the quantity of water added in the mixer by means of an automatic feed-forward regulating loop with injection of a signal corresponding to this quantity into an automatic feedback regulating loop based on another permeameter situated downstream of the mixer.

In accordance with another mode of carrying the invention into effect, the value of the permeability measured upstream of the mixer which directly precedes the feed hopper is utilized to influence the quantity of water added in the mixer by means of an automatic feed-forward regulating loop and simultaneously for influencing the quantity of water added in another mixer situated upstream of the aforementioned mixer by means of an automatic feedback regulating loop.

BRIEF DESCRIPTION OF THE DRAWINGS

The invention will be described further, by way of example only, with reference to the accompanying drawings, in which:

FIG. 1 relates to a control method using a single permeameter incorporated in an automatic feed-forward regulating loop;

FIG. 2 relates to a control method using two permeameters, one of which is incorporated in an automatic feed-forward regulation loop and the other of which is incorporated in an automatic feedback regulation loop, these two loops functioning simultaneously for adjusting the addition of water in one and the same mixer, which directly precedes a feed hooper feeding an agglomerating apparatus;

FIG. 3 relates to a control method using a permeameter which is incorporated, on the one hand, in an automatic feed-forward regulation loop for a mixer situated downstream and, on the other hand, in an automatic feedback regulation loop for another mixer situated upstream; and FIG. 4 relates to a control method using two permeameters which combines the two methods of FIGS. 2 and 3;

DETAILED DESCRIPTION OF THE PREFERRED EMBODIMENTS

Figure 1:
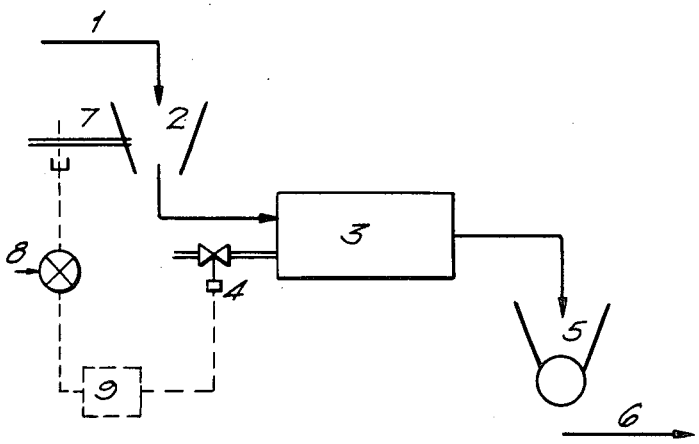
FIGS. 1 to 4 are flow diagrams of iron-ore agglomeration processes includng control methods according to the invention, as follows.

According to FIG. 1 a mixture 1 to be agglomerated (sintered) passes through a hopper 2 which feeds a mixer 3 furnished with a gate valve 4 for the addition of water. At the output of the mixer 3 the mixture traverses a feed hopper 5 which supplies an agglomerating apparatus 6 (a sinter strand).

The hopper 2 is furnished with a permeameter 7 which forms part of the circuit for automatic feed-forward regulation set up to adjust the addition of water effected by means of the gate valve 4. This regulating circuit includes a reference device 8 with respect to the set value (such as a comparator or a filter) and a regulator 9 which transforms the permeability signal into a quantity of water.

With this arrangement, should the permeability of the mixture traversing the hopper 2 not be satisfactory, then it is yet possible to effect an appropriate correction to the water by means of the gate valve 4 so that the agglomerating apparatus 6 is supplied with a mixture of desired permeability.

Figure 2:
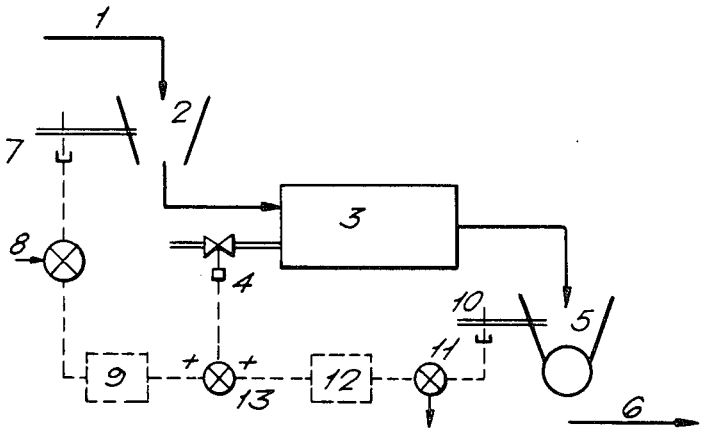

The scheme of FIG. 2 is the same as that of FIG. 1 in respect of the path of the mixture to be agglomerated (1, 2, 3, 4, 5, 6). The permeameter 7 of the hopper 2 is likewise the same, but a second permeameter 10 is furnished for the hopper 5. This latter permeameter 10 forms part of a circuit for automatic feedback regulation connected to the gate valve 4 and including a reference device 11 with respect to a set value and a regulator 12.

The water correction arising from the regulator 9 (through the feed-forward loop 7-8-9-4) and that arising from the regulator 12 (through the feedback loop 10-11-12-4) are subjected to addition in a summator 13 prior to being transmitted to the controls for the gate valve 4.

Figure 3:
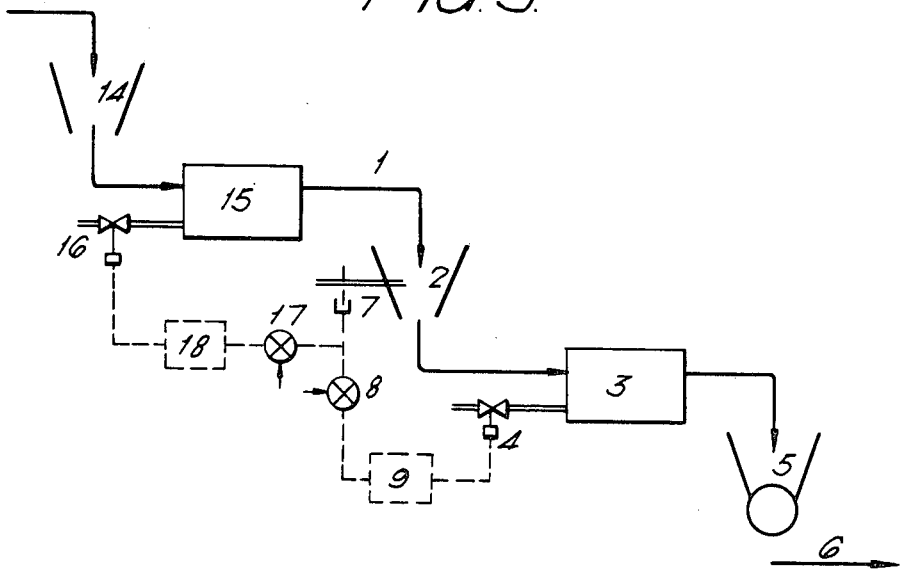

According to FIG. 3 the mixture to be agglomerated traverses first through a hopper 14 supplying a mixer 15 prior to traversing the hopper 2 supplying the mixer 3. The initial mixer 15 is likewise furnished with a gate valve 16 for the addition of water, which forms part of a circuit for automatic feedback regulation and which moreover includes the permeameter 7, a reference device 17 with respect to the set value, and a regulator 18. This regulating loop functions simultaneously with the first loop for automatic feed-forward regulation 7-8-9-4.

Figure 4:
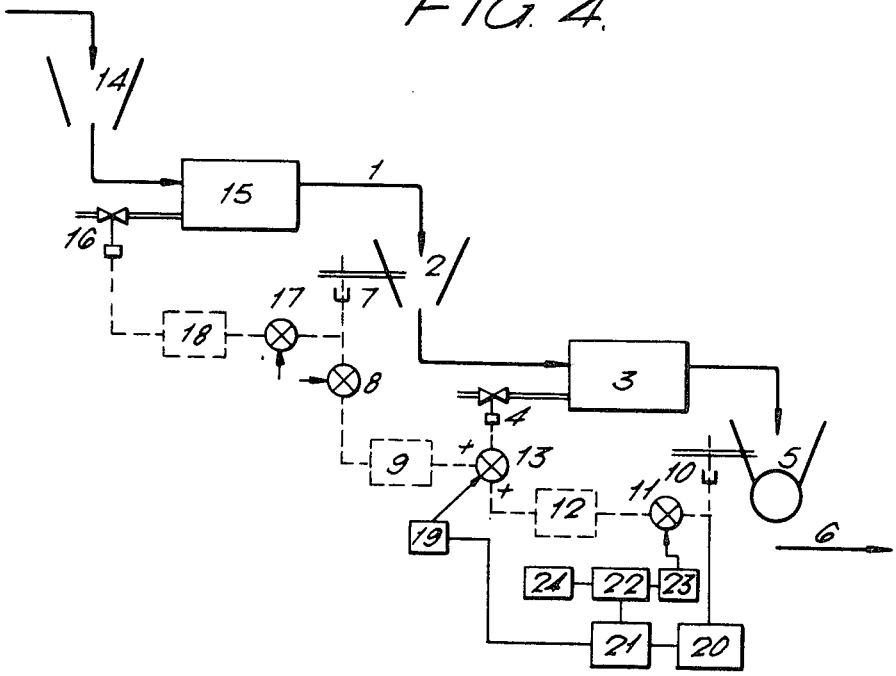

The scheme of FIG. 4 is the same as that of FIG. 3 in regard to the path of the mixture to be agglomerated (14-15-16-1-2-3-4-5-6). The permeameter 7 of the hopper 2 likewise forms part, on the one hand, of a loop for automatic feed-forward regulation 7-8-9-4 and, on the other hand, of a loop for automatic feedback regulation 7-17-18-16. This installation moreover includes a second permeameter 10 equipping the hopper 5 and forming part of a loop for automatic feedback regulation 10-11-12-13-4. The three regulating loops function simultaneously.

With a view to adapting in a continuous and automatic manner the value P° of the set value of the permeability of the mixture as a function of the variations of the characteristics of the mixture, variations ($\Delta Q$) of the quantity (Q) of water to be added can be effected as desired through a generator 19. Consequent upon such desired variation, the permeability measured in the hopper 5 undergoes likewise a variation which is detected through the use of a filter 20. The signal representing this variation is transmitted to a divider module 21 connected also to the generator 19. The module 21 emits a signal representative of the ratio $\Delta P/\Delta Q$ which is received in a comparator 22 where there is effected the comparison between the signal representing $\Delta P/\Delta Q$ and a predetermined value 24 chosen as a set value. The comparator 22 is connected to a regulator 23 furnished to transmit to the reference device 11, which serves as indication of the set value P°, any variation corresponding to a deviation (as made evident by the comparator 22) between the calculated values $\Delta P/\Delta Q$ and the regulating value 24, in such manner that this deviation may be suppressed as rapidly as possible.

EXAMPLE

For a sinter strand moving at an average speed of 3m/min, a mixture for sintering comprised:

20% of minette iron ore
30% of magnetite
25% of haematite
25% of diverse added matter (flux, etc).

The entirely automatic functioning of the regulation enabled the permeability to be maintained at its set value (35 $m^3/h$) to an accuracy of $\pm$ 2 $m^3/h$ during 93.5% of the flow time.

Figure 5:
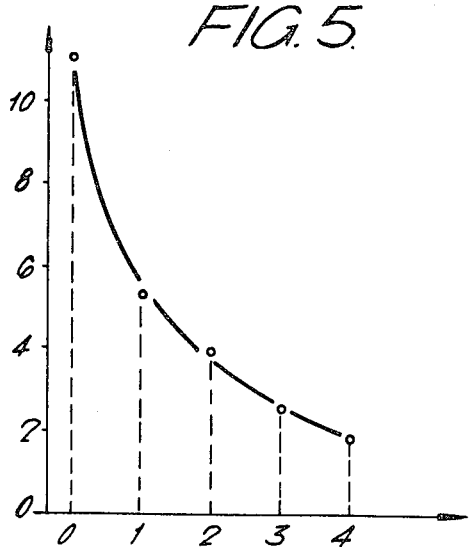
FIG. 5 is a graph of fluctuation in permeability against type of control.

In the curve shown in FIG. 5 the abscissae indicate the type of control effected (in conjunction with FIGS. 2 and 4) and the ordinates indicate, in percent values, the diminution in the residual fluctuation of the permeability.

The different types of control are, for the abscissae,
at 0: with manual control; 11%
at 1: with motor control; 5.5%
at 2: with feedback on the permeameter 10; 4%
at 3: with feedback on the permeameter 10; and a feed-forward on the pelletizer 3; 2.5% at 4: same as 3 with, in addition, feedback on the first permeameter 7; 1.7%

It may be noted that the automatic adaptation of the set value of permeability as a function of the characteristics of the mixture permits a step up of about 3.5% (relative) to be obtained in the value of the permeability, which enables a corresponding increase in the conveyor productivity to be obtained.

Figure 6:
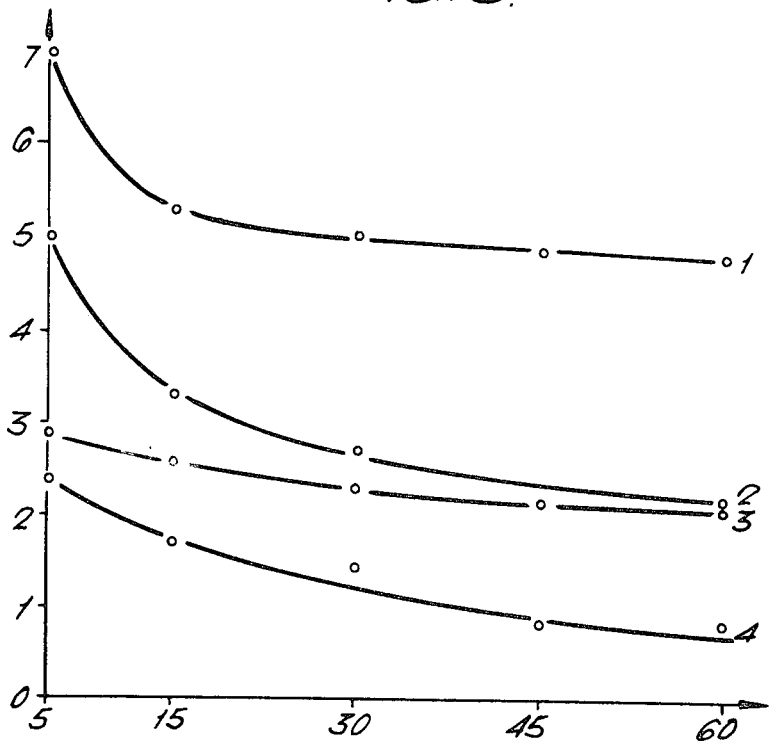
FIG. 6 is a graph of deviation of permeability against time.

In FIG. 6, the ordinates show in percent values the variation in the dispersion of the residual permeability for the same types of control as mentioned above (manual control excepted), this being as a function of the duration of the perturbations in minutes. The four curves indicated at 1, 2, 3, 4 correspond to the four types of control as already indicated in FIG. 5.

From the above, the conclusion can be drawn that the feedback loops are particularly efficascious for perturbations of long duration, while the existance of a feed-forward loop is especially efficacious in the case of perturbations of short duration.

We claim:

1. A method of controlling an iron-ore agglomeration process comprising: measuring the permeability of a mixture to be agglomerated, by means of a permeameter situated upstream of a mixer directly preceding a feed hopper feeding an agglomerating apparatus; adding water the mixture in the mixer; utilizing the measured permeability value to influence the quantity of water added in the mixer by means of an automatic feed-forward regulating loop; measuring the permeability of the mixture by means of a further permeameter situated downstream of the mixer and upstream of the feed hopper; and utilizing the measured permeability value thus obtained to influence the quantity of water added in the mixer by means of an automatic feedback regulating loop; and combining the influences of the two regulating loops so as to obtain at the output of the mixer a given value of the permeability of the mixture to be agglomerated.

2. A method of controlling an iron-ore agglomeration process comprising: measuring the permeability of a mixture to be agglomerated, by means of a permeameter situated upstream of a mixer directly preceding a feed hopper feeding an agglomerating apparatus; adding water to the mixture in the mixer; utilizing the measured permeability value to influence the quantity of water added in the mixer by means of an automatic feed-forward regulating loop; and utilizing the value of the permeability measured upstream of the mixer to influence the quantity of water added in another mixer situated upstream of the said mixer by means of an automatic feedback regulating loop, so as to obtain at the output of each mixer a given value of the permeability of the mixture to be agglomerated.

3. A method of controlling an iron-ore agglomeration process comprising: measuring the permeability of a mixture to be agglomerated, by means of a permeameter situated upstream of a mixer directly preceding a feed hopper feedng an agglomerating apparatus; adding water to the mixture in the mixer; utilizing the measured permeability value to influence the quantity of water added in the mixer by means of an automatic feed-forward regulation loop; measuring the permeability of the mixture by means of a further permeameter situated downstream of the mixer and upstream of the feed hopper; utilizing the measured permeability value thus obtained to influence the quantity of water added in the mixer by means of an automatic feedback regulating loop; combining the influences of the two regulating loops so as to obtain at the output of the mixer a give value of the permeability of the mixture to be agglomerated; and utilizing the value of the permeability measured upstream of the mixer to influence the quantity of water added in another mixer situated upstream of the said mixer by means of an automatic feedback regulating loop, so as to obtain at the output of this upstream mixer a given value of the permeability of the mixture to be agglomerated.

* * * * *